US012654811B2

(12) United States Patent
Merchant et al.

(10) Patent No.: US 12,654,811 B2
(45) Date of Patent: Jun. 16, 2026

(54) NEARSHORE LOGISTICS ANCHORAGE HUB

(71) Applicant: Seatrium New Energy Limited, Singapore (SG)

(72) Inventors: Aziz Amirali Merchant, Singaopre (SG); Murthy Pasumarthy, Singapore (SG); Chong Yong Huang, Singapore (SG); Hing Chu Chin, Singapore (SG); Xiao Liu, Singapore (SG)

(73) Assignee: Seatrium New Energy Limited, Singapore (SG)

( * ) Notice: Subject to any disclaimer, the term of this patent is extended or adjusted under 35 U.S.C. 154(b) by 344 days.

(21) Appl. No.: 18/293,212

(22) PCT Filed: Jul. 22, 2022

(86) PCT No.: PCT/SG2022/050516
§ 371 (c)(1),
(2) Date: Jan. 29, 2024

(87) PCT Pub. No.: WO2023/014287
PCT Pub. Date: Feb. 9, 2023

(65) Prior Publication Data

US 2024/0343350 A1 Oct. 17, 2024

(30) Foreign Application Priority Data

Aug. 2, 2021 (SG) ..... 10202108432P

(51) Int. Cl.
*B63B 22/02* (2006.01)
*B63B 21/00* (2006.01)

(52) U.S. Cl.
CPC ..... *B63B 22/02* (2013.01); *B63B 2021/005* (2013.01)

(58) Field of Classification Search
CPC ..... B63B 22/02; B63B 2021/005; B63B 2021/003; B63B 21/00
See application file for complete search history.

(56) References Cited

U.S. PATENT DOCUMENTS 3,516,259 A * 6/1970 Tokola ..... E02B 17/0013 405/208
2011/0305521 A1 12/2011 Henstra et al.
2021/0017727 A1 1/2021 Van Loon et al.

FOREIGN PATENT DOCUMENTS

CN 109537555 A 3/2019
KR 20200002420 A 1/2020
KR 102167255 B1 * 10/2020 ..... E02B 3/068

OTHER PUBLICATIONS

Search Report dated Jan. 12, 2022, issued by the Intellectual Property Office of Singapore issued in connection with Singapore Application No. 10202108432P (3 pages).

(Continued)

*Primary Examiner* — Sabbir Hasan
(74) *Attorney, Agent, or Firm* — McCarter & English, LLP

(57) ABSTRACT

The application provides a floating structure for mooring a vessel in a water body, comprising a hull having a plurality of dampers disposed on lateral sides or corners of the hull, a plurality of piles erected in the water body around a periphery of the hull, wherein each of the piles comprises a guiding plate having one or more guiding surfaces for coupling to at least one damper, one or more auxiliary piles connected to the pile by truss structure and partially embedded in the water body, the hull is vertically slidably coupled to a plurality of piles by slidably coupling the dampers to corresponding guiding surfaces of the guiding plate on the piles. The application also provides a plurality of floating (Continued)

structures linked to form a water-based hub serving as a novel nearshore logistics anchorage hub.

11 Claims, 6 Drawing Sheets

(56) References Cited

OTHER PUBLICATIONS

Randolph, et al., "Challenges of Offshore Geotechnical Engineering," Proceedings of the 16th International Conference on Soil Mechanics and Geotechnical Engineering, vol. 16, No. 1 (2005) (55 pages).
International Search Report of the International Searching Authority mailed on Apr. 3, 2023, issued in connection with International Application No. PCT/SG2022/050516 (4 pages).
Written Opinion of the International Searching Authority mailed on Apr. 3, 2023, issued in connection with International Application No. PCT/SG2022/050516 (4 pages).
International Preliminary Report on Patentability dated Aug. 18, 2023, issued in connection with International Application No. PCT/SG2022/050516 (12 pages).

* cited by examiner a)

b)

c)

NEARSHORE LOGISTICS ANCHORAGE HUB

RELATED APPLICATIONS

This application is a U.S. National Phase Application under 35 U.S.C. 371 of International Application No. PCT/SG2022/050516 filed Jul. 22, 2022, which claims the benefit of Singapore Patent Application No. 10202108432P filed on Aug. 2, 2021. The disclosures of these applications are expressly incorporated herein by reference in their entireties.

FIELD OF THE INVENTION

The present invention generally concerns a water-based structure, in particular a floating structure for mooring one or more vessels to optimize anchorage space, and a modular water-based hub based on the floating structure. Such modular water-based hub may serve as a novel nearshore logistics anchorage hub.

BACKGROUND OF THE INVENTION

Traditional mooring method typically utilises a heavy weight such as a concrete block that rests on a floor of a water body while connected to a float on the water surface by a chain. A vessel moors by connecting to the float which provides anchorage for the vessel. Such mooring method requires that each moored vessel has 360 degrees of clearance to avoid collision with an adjacent moored vessel under the prevailing environmental conditions. As an example, for an anchored vessel with a length of 120 m, a clearance of estimated radius 285 m is required which translates to approximately 255,000 $m^2$ of anchorage space. This poses a severe limitation on the number of moorings per unit area of available anchorage space.

In view of the above, there is an increasing need for more efficient systems for mooring vessels. The capability to moor a large number of vessels within a confined anchorage space opens up many possibilities, for instance, in managing heavy traffic at sea ports by providing for a nearshore water-based hub where vessels can moor while waiting to enter the port, or in building sea ports or other facilities offshore to alleviate demands for coastal space.

It is an objective of this invention to provide a floating structure for mooring vessels efficiently. The floating structure deploys effective station-keeping to maintain a position of the floating structure while in operation, and can be easily installed and scaled up. It is another objective of this invention to provide a water-based hub. Such water-based hub may serve as a nearshore logistic hub for vessels to moor, unload and replenish supplies without having to enter an onshore port.

SUMMARY OF THE INVENTION

The above and other problems in the art are solved and an advance in the art is made in accordance with this invention.

A first advantage of a floating structure in accordance with this invention is that the floating structure maximises use of available anchorage space to moor a plurality of vessels in an efficient manner.

A second advantage of a floating structure in accordance with this invention is that the floating structure is of a simple design and can be easily installed and scaled up to realise a water-based hub for varying functions.

A third advantage of a floating structure in accordance with this invention is that the floating structure is stable, exhibits good station keeping and is able to compensate for environmental conditions such as tidal changes.

A fourth advantage of a floating structure in accordance with this invention is that the floating structure minimises disruption to the environment where the floating structure is installed.

In accordance with a first aspect of the invention, the invention provides a floating structure for installing in a water body. The floating structure comprises a hull, a plurality of dampers that are disposed on lateral sides or corners of the hull for absorbing physical impacts on the hull, a plurality of piles configured to be erected in the water body around a periphery of the hull. Each of the plurality of piles comprises a first end, a guiding plate coupled near the first end, wherein the guiding plate includes one or more guiding surfaces for coupling to at least one damper from the plurality of dampers respectively. Each of the plurality of piles further comprises a second end configured to be embedded in a floor of the water body, and one or more auxiliary piles connected near the second end of the pile by truss structures and configured to be partially embedded in the floor of the water body. The hull is configured to float on the water body and is coupled to the first end of the plurality of piles by slidably coupling the plurality of dampers to corresponding guiding surfaces on the plurality of piles such that the hull is confined within a space defined by the plurality of piles and the hull is able to translate substantially vertically in the water body by sliding along longitudinal axes of the plurality of piles.

In accordance with embodiments of the first aspect of the invention, each of the plurality of piles comprises two auxiliary piles connected near the second end of the pile to form a tripod structure.

In accordance with embodiments of the first aspect of the invention, the floating structure further comprises a plurality of low-friction pads, wherein each of the plurality of low-friction pads is disposed between the damper and the gliding surface.

In accordance with embodiments of the first aspect of the invention, the hull of the floating structure is of a catamaran form.

In accordance with embodiments of the first aspect of the invention, the hull of the floating structure comprises a plurality of cut outs for receiving each of the plurality of piles respectively.

In accordance with embodiments of the first aspect of the invention, each of the plurality of cut outs comprises a V-shaped groove with two adjacent faces, each adjacent face comprising one of the plurality of dampers.

In accordance with embodiments of the first aspect of the invention, the hull is substantially rectangular in cross-section with the V-shaped groove at each corner of the hull.

In accordance with embodiments of the first aspect of the invention, the floating structure may be installed in a water body for use in berthing or mooring one or more vessels.

In accordance with a second aspect of the invention, a water-based hub is disclosed. The water-based hub comprises a plurality of the floating structures of the first aspect linked by one or more interconnecting structures.

In accordance with embodiments of the second aspect of the invention, the one or more interconnecting structure is a bridge.

In accordance with embodiments of the second aspect of the invention, the water-based hub may be used as a nearshore logistics anchorage hub where vessels berth and moor to unload or replenish supplies without having to enter a seaport.

BRIEF DESCRIPTION OF THE DRAWINGS

The drawings illustrate, by way of example, exemplary embodiments of the invention and should not be taken to be limiting the scope of the invention.

DETAILED DESCRIPTION

Embodiments of the invention are described herein. The person of ordinary skill in the art will realize that the following description of the invention is for illustrative purposes only and should not be seen in any way as limiting the scope of the invention. Other embodiments of the invention may be devised by such skilled persons without deviating from the present invention. For instance, new embodiments may be derived by selecting and combining various features as disclosed herein and such embodiments are considered to be encompassed by the present invention.

To facilitate understanding of the invention, similar features are allocated identical numeric labels in the figures.

Figure 1A:
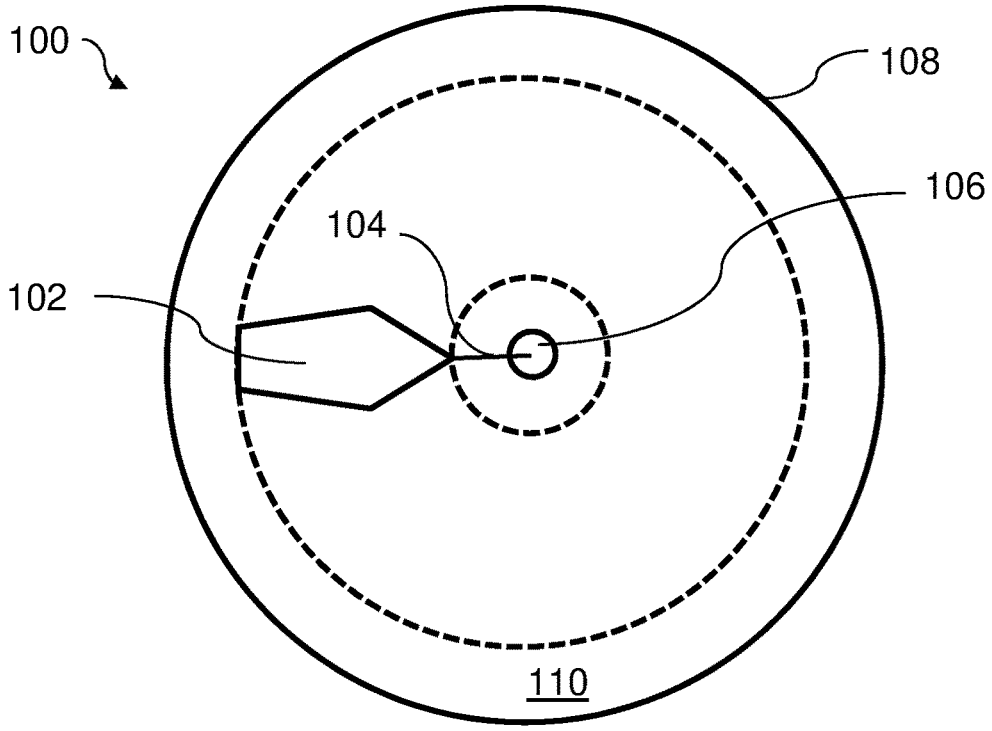
FIG. 1a (prior art)
FIGS. 1*a* to 1*b* are schematic drawings of a system for mooring one or more vessels in accordance to prior art.

FIG. 1*a* shows a conventional setup (100) in a water body for mooring a vessel (102). The vessel (102) is connected via a line (104) which may be a rope or chain to a float (106) that is anchored to a floor of the water body. The vessel (102) is subjected to the prevailing environmental conditions and swings freely around the float (106). Therefore, ample anchorage space (108) with 360 degrees of clearance including safety distancing (110) is required to avoid collision with an adjacent moored vessel. Each moored vessel thus occupies a significant amount of anchorage space beyond the actual footprint of the vessel.

Figure 1B:
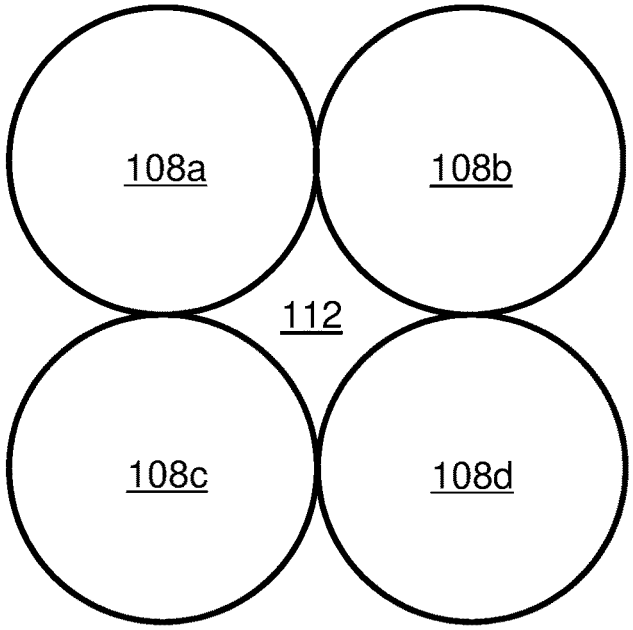
FIG. 1b (prior art)

FIG. 1*b* shows a typical layout comprising adjacent anchorage spaces (108*a* to 108*d*) and unutilized space (112), demonstrating further inefficiency of the conventional mooring setup.

Figure 2:
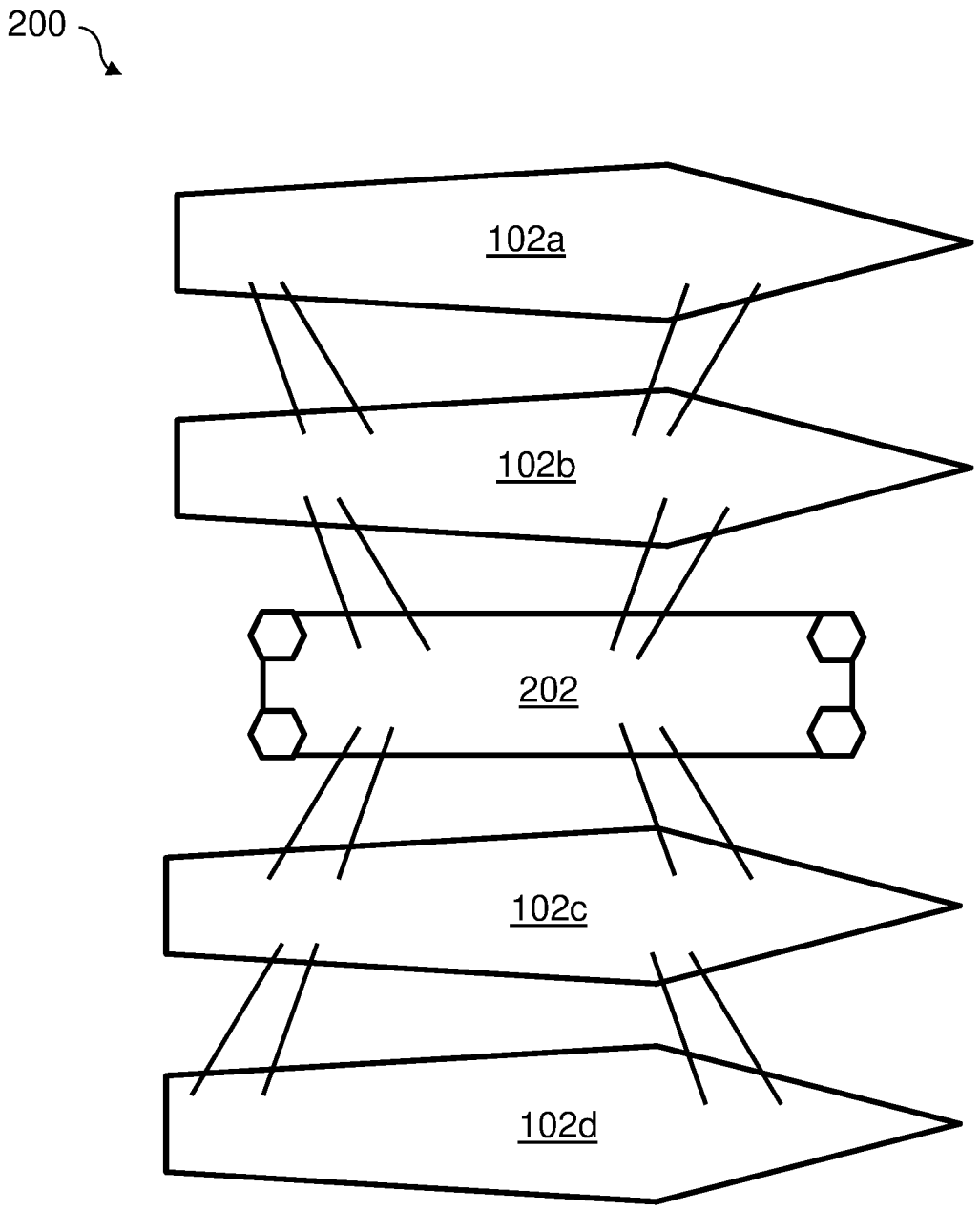
FIG. 2 is a schematic drawing of an exemplary system for mooring a plurality of vessels in accordance with an embodiment of the invention.

FIG. 2 shows an embodiment of the present invention (200) for more efficient vessel mooring. Floating structure (202), as shall be elaborated in the following paragraphs, provides a stable and station-keeping platform for mooring multiple vessels (102*a* to 102*d*). Vessels (102*b* and 102*c*) may be connected via lines like chains or ropes directly to the floating structure (202). Additional vessels (102*a* and 102*d*) may be moored by connecting to vessels (102*b* and 102*c*) respectively. Fenders (not shown) that are pre-installed on a periphery of the floating structure (202) and the vessels help dampen impact of any collision. In this way, the floating structure (202) allows multiple vessels to be densely moored to maximise use of available anchorage space. It should be noted that while FIG. 2 shows four vessels, this is not to be seen as limiting to the capacity of the floating structure (202). Depending on the design of the floating structure (202), the number of vessels that may be moored can vary.

Figure 3:
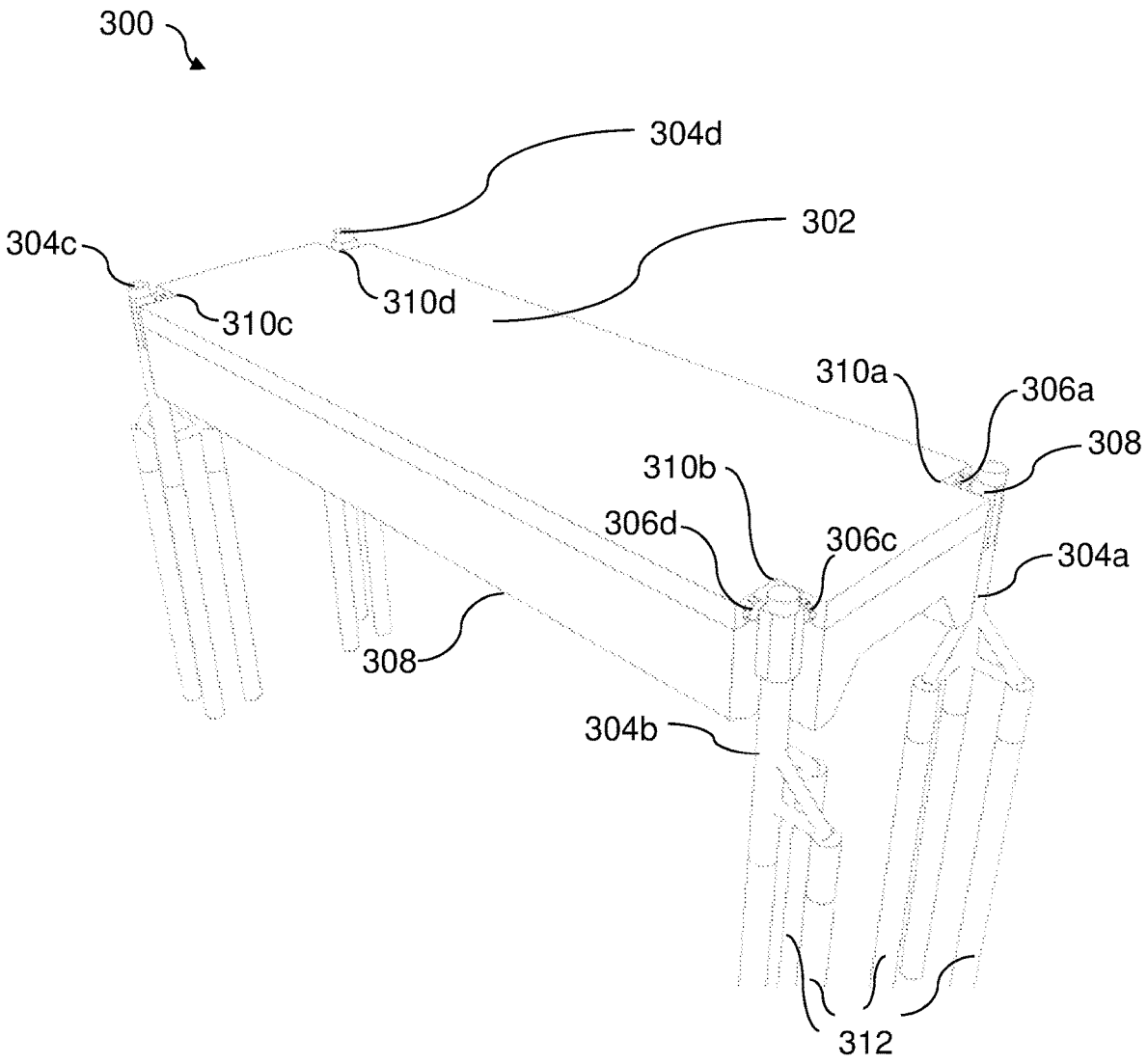
FIG. 3 is a schematic drawing of a floating structure in accordance with an embodiment of the invention.

FIG. 3 shows a preferred embodiment of a floating structure (300) in accordance with the present invention. The floating structure (300) comprises a hull (302) that is capable of floating on a surface of a water body, and a plurality of piles (304*a* to 304*d*) that are erected in the water body with a first end near or protruding above a water surface of the water body and a second end that is embedded in a floor of the water body. The hull (302) is coupled to the first end of the plurality of piles (304*a* to 304*d*).

Critically, the plurality of piles (304*a* to 304*d*) are positioned around a periphery of the hull (302) and coupled to lateral sides or corners of the hull (302). Hence, the plurality of piles (304*a* to 304*d*) do not pass through a body of the hull (302).

Further, the first end of the plurality of piles (304*a* to 304*d*) are configured to extend beyond a bottom side of the hull (308) when the hull is in the water body. In this way, the plurality of piles (304*a* to 304*d*) physically confine the hull (302) to within a space that is defined by locations of the plurality of piles (304*a* to 304*d*) and restrict lateral movements of the hull (302). This enables the hull (302) to maintain position (i.e. station keep) and stabilises the hull (302) by minimising movement resulting from, for instance, environmental conditions like prevailing wind and tides.

As shown in FIG. 3, a plurality of dampers (only 306*a, c, d* are in view) are disposed on the lateral sides or corners of the hull (302) and coupled to the plurality of piles (304*a* to 304*d*). The plurality of dampers are capable of elastic deformation and aid in transfer of load on the hull (302) to the plurality of piles (304*a* to 304*d*). Therefore, the plurality of dampers absorbs physical impacts on the hull (302).

Preferably, the hull (302) comprises a plurality of cut outs for receiving each of the plurality of piles (304*a* to 304*d*). As shown in FIG. 3, the plurality of cut outs may take the form of a plurality of V-shaped grooves (310*a* to 310*d*) comprising two adjacent faces each. One damper may be disposed on each of the adjacent faces of the V-shaped groove (310). The hull (302) is preferably of a rectangular cross-section with the V-shaped grooves (310*a* to 310*d*) positioned at corners of the rectangular cross section. Hence, the floating structure (300) comprises four piles that are individually coupled to each of the V-shaped grooves on the corners of the rectangular hull (304).

In some embodiments, under normal conditions, the hull (302) may couple to each of the plurality of piles with a gap between the pile and a corresponding damper of the plurality of dampers disposed on the hull. As the hull moves towards the pile under the prevailing environmental conditions, the gap closes as the hull impacts the pile with the corresponding damper compressing to absorb the physical impact.

Figure 4:
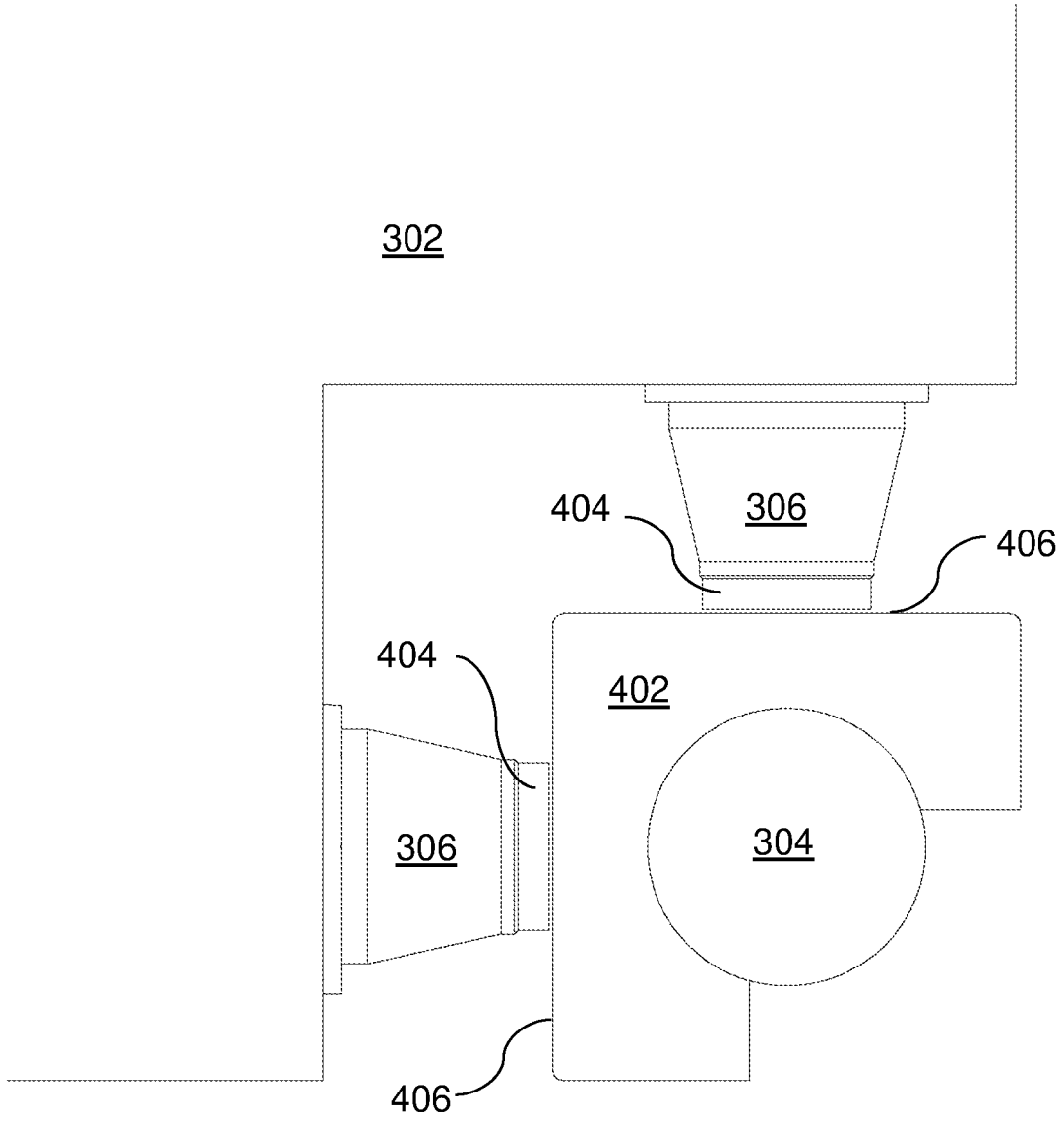
FIG. 4 is a schematic drawing of a close-up view of a preferred coupling between the hull and pile of the floating structure in accordance with an embodiment of the invention.

FIG. 4 shows a close-up view of a preferred coupling between the hull (302) and pile (304). Preferably, a guiding plate (402) is mounted or welded on each of the first end of the plurality of piles. The guiding plate (402) comprises one or more guiding surfaces (406) for coupling to at least one damper (306) of the plurality of dampers respectively. Further, low-friction pads (404) are disposed between the damper (306) and gliding surface (406). The hull (302) is coupled to the pile (304) by slidably coupling the damper (306) with the low-friction pads (404) to the guiding surface (406) of the guiding plate (402). The guiding plate (402)

guides a sliding motion of the damper (306) with low-friction pad (404) along the guiding surface. This enables the hull (302) to translate substantially vertically in the water body to compensate for changes in environment conditions such as wind and tide.

Preferably, the plurality of piles (304*a* to 304*d*) are erected substantially vertical. The lateral sides or corners of the hull (302) where the plurality of dampers (306) are disposed are also substantially vertical. The guiding plate (402) with guiding surfaces guides the hull (302) to slide parallel to longitudinal axes of the plurality of pile (304*a* to 304*d*).

Other means common in the art for slidably coupling the hull to the plurality of piles besides use of low-friction pad on a corresponding guiding surface may be used or devised by the skilled person in the art. For instance, rollers may be used in place of low-friction pads.

Referring back to FIG. 3, each of the plurality of piles (304*a* to 304*d*) comprises a plurality of auxiliary piles (312) connected to the pile by truss structures near the second end of the pile and configured to be at least partially embedded in the floor of the water body. The auxiliary piles and truss structures help to reduce any bending moment on the pile arising from lateral movement of the hull (302), hence lowering requirements (mechanical strength, size, thickness, etc.) of the pile that can facilitate installation, reduce cost and minimize disruption to the floor of the water body.

Preferably, each of the plurality of piles (304*a* to 304*d*) is connected to two auxiliary piles hence forming a tripod structure at the second end of the pile.

More preferably, the plurality of auxiliary piles (312) are connected to the pile (304) below a pre-determined water depth to avoid becoming an obstacle to a mooring vessel.

Preferably, as shown in FIG. 3, the hull (302) is of a catamaran form. The double hull form of the catamaran has a wider beam compared to a mono-hull and can provide a higher righting moment to reduce roll motion. Further, the catamaran has a lower water plane compared to the mono-hull that can reduce heave motion. These contribute to increased stability over the mono-hull.

While FIG. 3 shows the hull (302) to possess a substantially rectangular cross section with four piles, this is not to be seen as limiting to the scope of the invention. The skilled person would be able to devise a floating structure comprising a hull of other arbitrary shapes in accordance to environment conditions or vessel size requirements, and such floating structures are considered to be within the scope of the current invention. Similarly, the number of piles may vary dependent on factors such as the size and shape of the hull, environment conditions and loading on the hull.

The floating structure described in the preceding paragraphs provides an efficient solution to mooring vessels with maximize use of available space, as shown in FIG. 2. The floating structure of the present invention is of a simple design and may be easily modified and maintained to operate in varying environments. By constraining the hull within confines of a space defined by a plurality of piles embedded in a floor of a water body, the hull exhibits excellent station keeping with minimal lateral movement. The hull is able to compensate for environment conditions like tidal changes by sliding substantially vertically along the plurality of piles. The floating platform is able to withstand environmental loads arising from prevailing wind and tidal conditions, and load arising from mooring operations by transferring the load to the plurality of piles via guiding plates. Dampers and auxiliary piles help in dissipating the load and reduces any bending moment on the piles.

Figure 5:
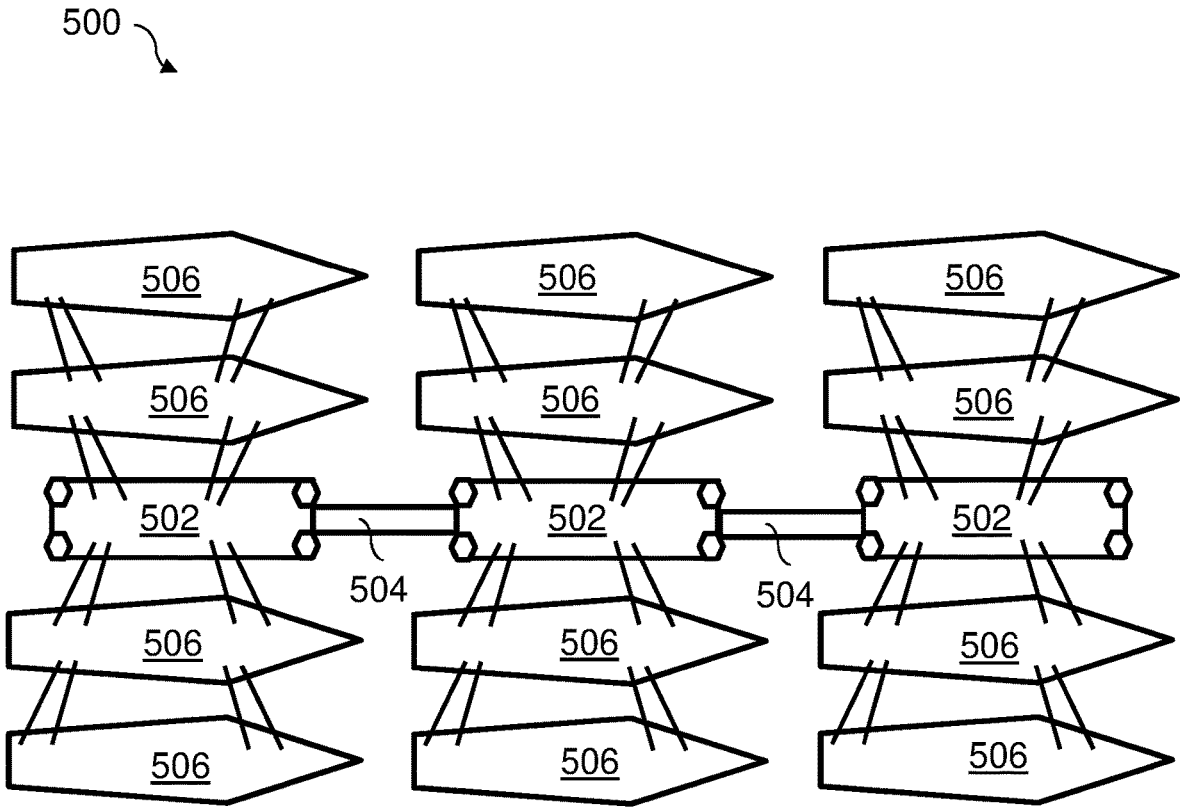
FIG. 5 is a schematic drawing of a water-based hub in accordance with an embodiment of the invention.

In a second aspect of the invention, a water-based hub is realised by linking multiple floating structures that have been described in the preceding paragraphs. FIG. 5 shows a water-based hub (500) comprising multiple floating structures (502) linked by interconnecting structures (504) that may be in form of bridges. The water-based hub (500) provides mooring for multiple vessels (506).

Besides providing mooring, the water-based hub (500) may serve multiple functions. For instance, the floating structures (502) may house facilities which enable the water-based hub (500) to serve as a nearshore logistics anchorage hub whereby vessels can moor, and unload or replenish supplies without entering a seaport.

Preferably, the water-based hub (500) may be equipped with automatic mooring systems for berthing and mooring various types of vessels such as LNG tankers, oil tankers, container vessels, general cargo vessels, etc.

The water-based hub (500) may also provide electrical charging stations, LNG, fuel oil, lube oil, freshwater to the vessels, or to provide provision stores and cold rooms. Further, the water-based hub (500) may provide accommodate facilities for crew members of the moored vessels or hub, and be powered by renewable sources such as solar power, wind energy, tidal energy, wave energy.

Figure 6:
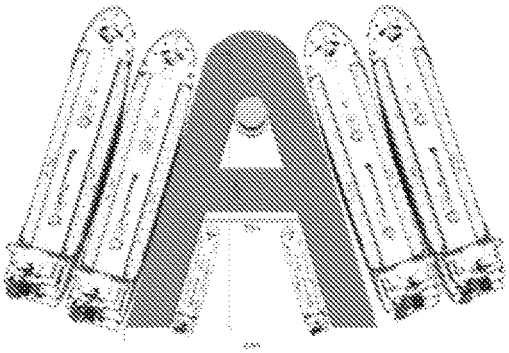
FIGS. 6*a* to 6*c* are schematic drawings of water-based hubs with varying layouts in accordance with embodiments of the invention.
Figure 6:
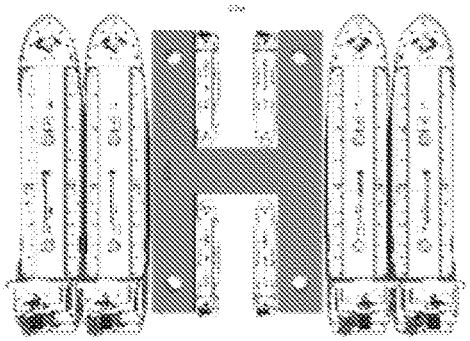
Figure 6:
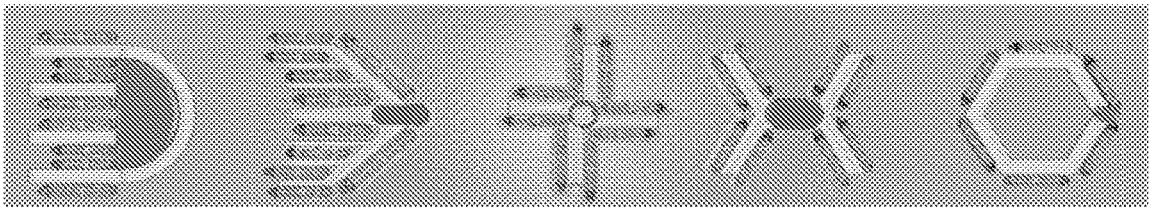

As can be seen from FIG. 5, the water-based hub (500) is highly modular in nature and can be easily scale up by linking more floating structures (502). FIG. 6 exemplifies some possible layouts for the water-based hub to maximize use of available space. FIG. 6*a* shows the floating structures to be arranged in the letter "A" configuration while FIG. 6*b* shows the floating structures to be arranged in the letter "H". Various layouts for the water-based hub (500) as seen in FIG. 6*c* may be devised by the skilled person.

The above is an exemplifying description of a floating structure and water-based hub. It is foreseen that those skilled in the art can and will design alternative embodiments of this invention as set forth in the following claims.

The invention claimed is:

1. A floating structure for installing in a water body, the floating structure comprising:

a hull;

a plurality of dampers disposed on lateral sides or corners of the hull for absorbing physical impacts on the hull;

a plurality of piles configured to be erected in the water body around the hull, each of the plurality of piles comprises:

a first end;

a guiding plate coupled near the first end, the guiding plate includes one or more guiding surfaces configured to about at least one damper from the plurality of dampers respectively a second end configured to be embedded in a floor of the water body; and one or more auxiliary piles connected near the second end of the pile by truss structures and configured to be partially embedded in the floor of the water body;

wherein each of the plurality of dampers is configured to slidably about a corresponding guiding surface of the guiding plate on the plurality of piles such that, the hull is confined within a space defined by the plurality of piles and the hull is able to translate substantially vertically in the water body by sliding along longitudinal axes of the plurality of piles.

2. The floating structure of claim 1, wherein each of the plurality of piles comprises two auxiliary piles connected near the second end of the pile to form a tripod structure.

3. The floating structure of claim 1, further comprising a plurality of low-friction pads, wherein each of the plurality of low-friction pads is disposed between the damper and the gliding surface.

4. The floating structure of claim 1, wherein the hull is of a catamaran form.

5. The floating structure of claim 1, wherein the hull comprises a plurality of cut outs for receiving each of the plurality of piles respectively.

6. The floating structure of claim 5, wherein each of the plurality of cut outs comprises a V-shaped groove with two adjacent faces, and wherein one of the plurality of dampers is disposed on each of the two adjacent faces.

7. The floating structure of claim 6, wherein the hull is substantially rectangular in cross-section with the V-shaped groove at each corner of the hull.

8. A method of use of the floating structure of claim 7 in berthing one or more vessels.

9. A water-based hub comprising the floating structure of claim 1, and at least one interconnecting structure, wherein the floating structure is linked to an adjacent floating structure by the at least one interconnecting structure.

10. The water-based hub of claim 9, wherein the interconnecting structure is a bridge.

11. A method of use of the water-based hub of claim 10 as a nearshore logistics anchorage hub, whereby one or more vessel may moor to the water-based hub to unload or replenish supplies.

* * * * *